United States Patent [19]

MacDonald et al.

[11] 4,442,946

[45] Apr. 17, 1984

[54] TAMPER RESISTANT CLOSURE APPARATUS

[76] Inventors: Christopher MacDonald, 2300 Fairview Ave., Apt. D-203, Costa Mesa, Calif. 92626; Vesta J. Crow, 21138 Adriatic Ave., Long Beach, Calif. 90810

[21] Appl. No.: 433,388

[22] Filed: Dec. 17, 1982

[51] Int. Cl.[3] ..... B65D 41/48

[52] U.S. Cl. ..... 215/230; 215/250; 215/277

[58] Field of Search ..... 215/365, 217, 221, 230, 215/250, 251, 203, 219, 225, 277; 220/258

[56] References Cited

U.S. PATENT DOCUMENTS 2,964,206 12/1960 Everett ..... 215/219

*Primary Examiner*—Donald F. Norton

*Attorney, Agent, or Firm*—Fulwider, Patton, Rieber, Lee & Utecht

[57] ABSTRACT

A tamper resistant closure including an inverted cup shaped shield for shrouding the cap of a bottle to restrict access to such cap for opening of the bottle. The shroud is formed with an aperture through which a stem on the cap projects and is held non-releasably locked in covering relationship on such cap by means of a compressible or resilient fastener conical head, the head being operative to compress and pass through such aperture and to then expand to nonreleasably lock the shroud in covering relationship on the cap.

10 Claims, 6 Drawing Figures

TAMPER RESISTANT CLOSURE APPARATUS

BACKGROUND OF THE INVENTION

1. Field of the Invention

The present invention relates to a closure for guaranteeing the integrity of the ingestible foods or medicines in a container.

2. Description of the Prior Art

In the field of bottle closures, numerous different child proof caps have been proposed for limiting access to the contents of the bottle itself. Numerous different caps have been proposed which satisfy the need for child proofing medicine bottles and the like. However, it is recognized that a danger stems from the fact that numerous different bottle caps may be removed from, for example, medicine bottles by unauthorized individuals and the content of such bottles adulterated and the cap replaced thus leaving an unsuspecting user exposed to the danger of ingesting the adulterated contents of the bottle. Consequently, there exists a need for enhancing the integrity of ingestable contents in a container, such as medicine bottles which are typically displayed in an open display area within retail stores within easy access to members of the public, demented members of which may be tempted to alter the contents of such bottles or even add poisonous substances thereto.

Various efforts to restrict access to the contents of a capped bottle have lead to halfway solutions. One such solution is the provision of a sealing band encircling the bottle cap and bottle neck. Such seals suffer the shortcoming that the efficacy thereof can be rather easily subverted, as by stretching the band slightly to enable release of the cap to gain access of the bottle and then replacing the cap while carefully stretching the seal back into its original position. Some such seals are rather easily duplicated by unsophicated means thus enabling a demented individual to duplicate the appearance of the original seal after committing his nefarious act. Consequently, there continues to exist a need for a device which may conveniently and inexpensively be applied to the cap at the time of bottling to restrict unauthorized access to the cap and which would leave perceivable evidence of unauthorized tampering.

SUMMARY OF THE INVENTION

The present invention is characterized by a cup shaped shroud for shrouding the removable cap of a container to restrict access thereto and which is coupled to the cap by means of a fastener which permits convenient coupling of the shroud to the cap but can be uncoupled only by permanent physical alteration thereof to thus leave perceivable evidence of tampering.

These and other objects and advantages of the present will become apparent from the following detailed description taken in conjunction with the accompanying drawing.

DESCRIPTION OF THE PREFERRED EMBODIMENT

Figure 1:
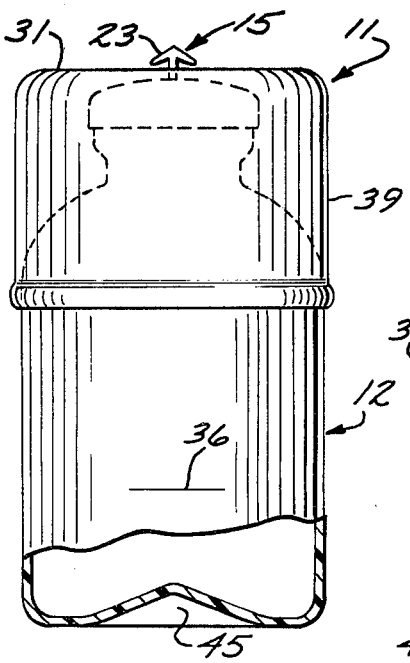
FIG. 1 is a side view, partially broken away, of a tamper resistant closure apparatus embodying the present invention.

Referring to FIG. 1, the tamper resistant closure of the present invention includes, generally, a shroud 11 in the form of an inverted cup revised and configured to fit over a bottle cap 13 and non-releasable locked in position by means of a fastener 15. Consequently, access to the contents of the bottle 12 necessitates severing of the fastener 15 from the cap 13 thus leaving perceivable evidence of the fact that the contents of the bottle 12 may have been adulterated prior to purchase by the potential consumer.

The bottle 12 may be in the form of any type of container for ingestible medicine for food or the like and may have a somewhat elliptical horizonal cross-section popular with many current day medicine bottles. The cap 13 is typically of plastic or metal and may be of the child proof type, either indexed or with normally disengaged screw threads.

The one-way fastener 15 is preferably formed integral with the cap 13 and incorporates a vertical stem 21 having a resilient arrowhead shaped head 23 thereon. The head 23 may be made of a relatively soft plastic which will permit the flanges thereof to bend downwardly and inwardly but the arrowhead configuration thereof prevents such flanges from being bent upwardly without breaking to thus lock the shroud 11 against removal without physical damage to such head 15. It will be appreciated by those skilled in the art that the cap 13, stem 21 and fastener head 23 may be molded integral with one another and, if desirable, may be formed of a plastic having different degrees of hardness and/or flexibility.

The bottle 12 may be a conventionally shaped container in the form of a medicine bottle or, may incorporate a peripheral rib 27 which is releasable engaged by the shroud 11 as described hereinafter.

The shroud 11 is cup shaped, and includes a top wall 31 formed centrally with a circular aperture 33 having a diameter somewhat less than the overall width of the fastener head 23 as defined by the distance from one extremity to the other of the flanges thereof. The shroud 11 is formed with a peripheral cylindrically shaped skirt 39 formed on its bottom extremity with a peripheral inwardly opening groove 41 which may be snapped over the rib 27 to releasably hold the shroud 11 in position and limit downward movement of such shield on the bottle 12 to maintain the top wall 31 spaced axially upwardly from the top surface of the cap 13 to positively prevent frictional engagement of such top wall with the top of the cap 13 without causing physical damage to such shield 13 and consequent evidence of tampering. In this regard, the shroud may be constructed of relatively hard plastic to prevent indentation of the top wall 31 sufficient to contact the cap 13 but with sufficient elasticity to enable the skirt to be snapped over the rib 27.

If desirable, the bottom wall of the bottle 12 may be formed with a somewhat conical shape to form a raised cavity 45 into which the head 15 of another bottle incorporating the shroud 11 may extend to thus facilitate stacking of bottles 12 on such shrouds.

The bottle 12 may be formed with an identification mark or number 36 and the cap 38 formed with a corresponding identification mark or number 38 such that the consumer, after removing the shroud 11, can compare such marks to provide additional assurance that the cap 13 corresponds with that applied to the particular bottle 12 at the time of bottling.

In operation, it will be appreciated that the bottles 12 of either conventional shape or formed with retaining ribs 27 and raised bottom cavities 45, may be fabricated and filled in the usual manner. The caps may be applied in the usual manner and tightened to a predetermined torquing to provide sufficient resistance to opening such that gripping the fastener head 15 with a pair of pliers and rotating the same will cause the stem 21 to separate prior to the time sufficient torque is applied to the cap 13 to enable such cap to be removed from the bottle top. Thereafter, the shroud 11 may be merely applied to the bottle top by inserting it there over, it being appreciated that the bottom of the skirt 39 has sufficient resilience to enable the groove 41 to be snapped over the rib 27. However, it will be appreciated that further downward travel of the shroud 11 relative to the bottle 12 is prevented due to the fact that the bottom extremity of the straight cylindrical skirt 39 abutts directly against the top of the rib 27 thus preventing further downward relative movement.

Figure 3:
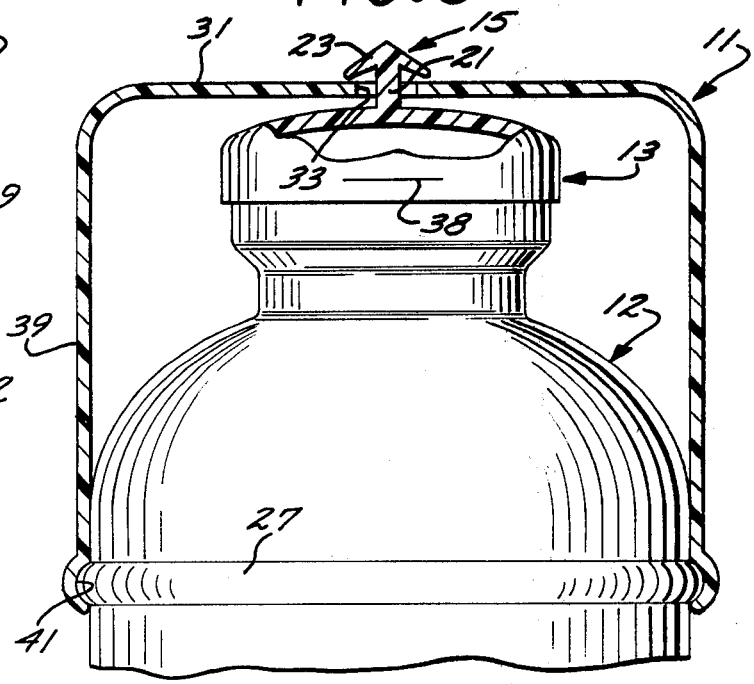
FIG. 3 is a vertical sectional view, in a large scale, take along the line 33 of FIG. 2.
Figure 2:
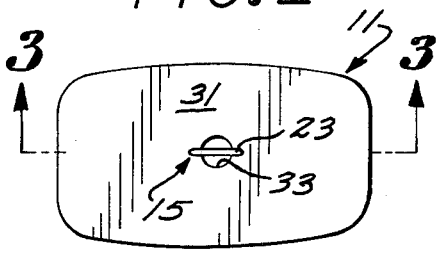
FIG. 2 is a top view of the tamper resistant closure apparatus shown in FIG. 1.

It will also be appreciated that as the shroud 11 is moved downwardly into covering position over the cap 13 the out extremity of the fastener head flanges will be bend downwardly and inwardly to thus enable the distorted arrowhead 23 to pass through the aperture 33 thus enabling such flanges to spring radially outwardly to assume the configuration shown in FIGS. 1, 2 and 3 overlying the opposite diametrical edges of the aperture 33. With the shroud 11 so installed, the secured bottle 12 is then ready for shipment to retail outlets where the bottle 12 may be placed on display shelves for display to the public.

In the event a mischievious individual gains possession of the bottle 12 from the public display 12 with the intention of gaining access to the contents of such bottle to contaminate same with a view that such contamination go undetected, his efforts would be foiled since any removal of the shroud would leave detectable evidence of either damage to the fastener head 23 or to the shroud itself thus alerting the merchant and consumer to the possibility that the contents of the bottle 12 have been contaminated. Even further security is provided against undetected contamination. Should the culprit elect to sever the stem 21 to enable removal of the shroud 11 and gain access to the cap 13 in effort to accomplish his objective of contamination, it would be necessary for him to replace the cap 13 with a cap having a similar appearance. However, his efforts to avoid detection of the evidence of possible contamination would be rendered extremely burdensome by the fact that any such replacement cap would not bear the identification mark 38 corresponding with the 36 on the model. Thus, a consumer subsequently purchasing bottle 12 of a contaminated goods, when comparing the identification marks would be alerted to the possibility of contamination thus giving him the opportunity to return the bottle to the merchant for analysis of the contents thereof.

Figure 4:
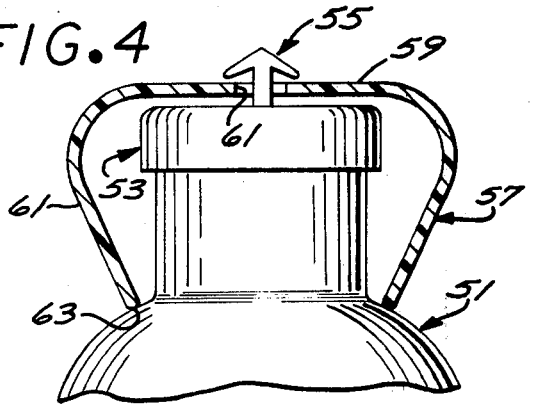
FIG. 4 is a vertical sectional view of a second embodiment of the tamper resistant closure apparatus of the present invention.

The second embodiment of the tamper resistant closure of the present invention as shown in FIG. 4 includes, generally, a bottle 51 having a cap 53 thereon which incorporates a fastener 55 similar to the fastener 15. The cap 55 is covered by a shroud, generally designated 57, which is formed with a top wall 59 having an aperture 61 similar to the aperture 33 shown in FIG. 3. The shroud 57 is formed with a frusto conically shaped peripheral skirt 61 which angles downwardly and inwardly to terminate in a bottom end defining a circular stop 63 which abutts against the top shoulder of the bottle 51. Thus, the top wall 59 of the shroud 57 is maintained spaced vertically above the top of the cap 53 to thus positively prevent an unscrupulous individual from pressing the such top wall 59 against the top of the cap 53 to make frictional contact therewith to enable rotation of such shroud 57 to impart an opening rotation action to the gap 53.

Figure 5:
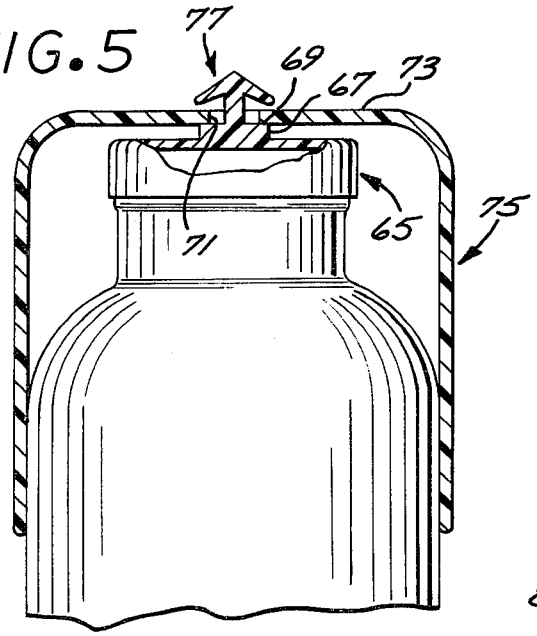
FIG. 5 is a vertical sectional view, partially broken away, of a third embodiment of the tamper resistant closure apparatus of the present invention; and, FIG. 6 is a side view of a forth embodiment of the tamper resistant closure apparatus of the present invention.

The third embodiment of the tamper resistant closure shown in FIG. 5 is similar to that shown in FIG. 3 except that the cap, generally designated 65, is formed centrally in its top wall with a raised cylindrical stop 67 forming an upwardly spacing shoulder 69 having a diameter slightly larger than an aperture 71 formed in the top wall 73 of a shroud, generally designated 75. A fastener, generally designated 77, then projects through the aperture 71. In this manner, the top wall 73 of the shroud 75 is stopped from making direct engagement with the top surface of the cap 65 to thus minimize any frictional torque that might be imparted to the top 65 by pressing downwardly on the shroud 75 during attempts to move the cap 65 without detection.

Figure 6:
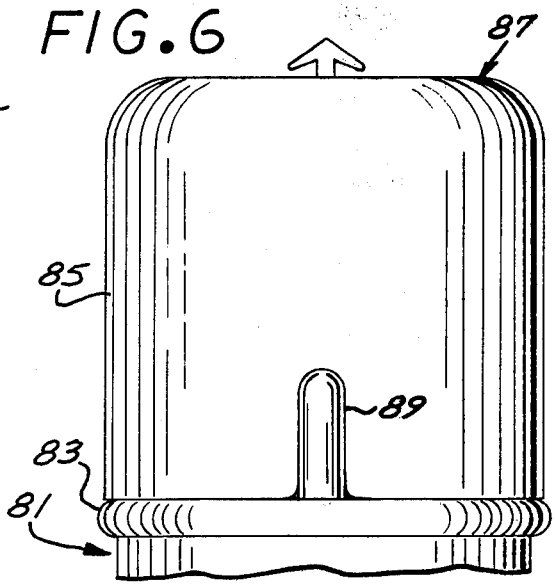

The embodiment shown in FIG. 6 is similar to that shown in FIG. 3 except that the bottle, generally designated 81, is formed with a peripheral rib 83 abutted by the lower edge of the skirt 85 of a shroud, generally designated 87. The bottle 81 is also formed with a short upstanding rib disposed above the peripheral stop rib 83 to engage a complimentary groove 89 formed in the skirt 85 to thus lock the shroud 87 against rotation relative to the model 81 thereby providing means to prevent such rotation which may be somehow imparted to the closure cap (not shown).

From the foregoing, it will be apparent that the tamper resistant closure apparatus of the present invention provides an economical and highly affective means for preventing undetected tamper. The tamper resistant closure apparatus provides an attractive display container which resists the efforts of the culprit while providing a closure which is convenient for the consumer to open and use.

I claim:

1. Tamper resistant closure apparatus comprising:

a container formed with a body having an opening;

a cap removably secured to said opening;

a fastener stem on said cap;

a cup shaped shroud for covering said cap and including a top wall spaced from and overlying the top of said cap and being formed centrally with an aperture receiving said stem, said shroud further including a peripheral skirt spaced from and projecting in covering relationship over the periphery of said cap to block access to said cap and;

a fastener head integral with said stem and operable to non-releasably lock said shroud over said cap to block access thereto whereby removal of said cap necessitates permanent physical alteration of said stem, head or shroud thus leaving perceivable evidence that said cap has been removed.

2. Tamper resistent closure apparatus as set forth in claim 1 wherein:

said head is arrowhead shaped.

3. Tamper resistant closure apparatus as set forth in claim 1 wherein:

said skirt is formed with stop means engageable with said container to limit movement of said top wall toward said cap to maintain said top wall spaced from said cap.

4. Tamper resistant closure apparatus as set forth in claim 1 wherein:

said container is in the form of a bottle.

5. Tamper resistant closure apparatus as set forth in claim 1 wherein:

said skirt terminates in an end which forms a stop to engage said container and limit relative movement between said container and shroud.

6. Tamper resistant closure apparatus as set forth in claim 1 wherein:

said container is formed with a peripheral rib; and, said skirt is formed with an inwardly opening groove releasably engaging said rib.

7. Tamper resistant closure apparatus as set forth in claim 1 wherein:

said container is formed with a stop; and said skirt terminates in an end engagable with said stop to limit movement of said top wall toward said cap to maintain said top wall spaced from said cap.

8. Tamper resistant closure apparatus as set forth in claim 1 wherein:

said container is formed in its periphery with a rib defining a key; and said shroud includes a groove engagable with said key to limit rotation of said shroud relative to said container.

9. Tamper resistant closure apparatus as set forth in claim 1 wherein:

said top wall of said shroud is rigid.

10. Tamper resistant closure apparatus as set forth in claim 1 wherein:

said container and cap include complimentary identification marks.

* * * * *